United States Patent [19]

Stott et al.

[11] Patent Number: 5,074,937

[45] Date of Patent: Dec. 24, 1991

[54] PREPARING AN ELASTOMERIC BOUND EXPLOSIVE

[76] Inventors: Barbara A. Stott, Rte. 1, Box 3490, Ridgecrest, Calif. 93555; Lily E. Koch, 112 Ocotillo St., Henderson, Nev. 89015; Reba C. Ward, 106A Mitscher, China Lake, Calif. 93555

[21] Appl. No.: 575,546

[22] Filed: May 8, 1975

[51] Int. Cl.[5] ..... C06B 45/10

[52] U.S. Cl. ..... 149/19.91; 149/19.92

[58] Field of Search ..... 149/19.91, 19.92

[56] References Cited

U.S. PATENT DOCUMENTS 3,009,386 11/1961 Billard ..... 149/19.92 X 3,520,742 7/1970 Witz ..... 149/19.91 X 3,537,922 11/1970 Gilman et al. ..... 149/19.91

3,809,586 5/1974 Waite ..... 149/19.91

*Primary Examiner*—Edward A. Miller

[57] ABSTRACT

Adhesives and binders for cast explosive compositions, pressed explosive compositions, propellants and pyrotechnic articles. The adhesives are prepared by reacting 2-ethylhexyl acrylate and N-vinyl-2-pyrrolidone in a copolymerization reaction with the aid of a suitable crosslinker. Binders are prepared by reacting the above-named monomers in a copolymerization reaction with the aid of a crosslinker and a curative. Copolymers prepared by reacting from 40 to 90 weight percent of the acrylate and from 60 to 10 weight percent of the pyrrolidone are preferred.

2 Claims, No Drawings

PREPARING AN ELASTOMERIC BOUND EXPLOSIVE

BACKGROUND OF THE INVENTION

1. Field of the Invention.

This invention relates to copolymeric materials which are useful as adhesives, as binders for explosive compositions, propellants and pyrotechnic articles and as binders for gas producing substances.

2. Description of the Prior Art.

In the recent past, several disastrous explosions have occurred both on shipboard and during rail transit when explosive compositions were inadvertantly subjected to heat or fires. Various explosive compositions, both plastic bonded and non-plastic bonded, too numerous to describe in detail here have detonated in such situations. Obviously, if explosive compositions will detonate under accidental, unexpected heat, it is undesirable to transport them in situations where they may be subjected to such heat. Because of these explosions, considerable research is now being carried out in attempts to develop explosive compositions which will burn rather than detonate if they are subjected to intense heat.

Under combat conditions as well as during shipping and storage, weapons such as warheads which contain explosive compositions are also subjected to mechanical shock and impact forces. It is desirable to have available explosives which will withstand such forces without detonating.

SUMMARY OF THE INVENTION

It has now been found that copolymers made by reacting from 40 to 90 weight percent 2-ethylhexyl acrylate with from 60 to 10 weight percent N-vinyl-2-pyrrolidone have a desensitizing effect on commonly used explosive fillers such as cyclotetramethylenetetranitramine (HMX) and cyclotrimethylenetrinitramine (RDX) or these explosives combined with aluminum powder and oxidizer powders such as sodium, ammonium or potassium perchlorates. When explosive compositions containing from 3 to 30 weight percent of such a copolymer as binders are subjected to impact, fast cookoff conditions or slow cookoff conditions, inadvertant explosions are significantly less likely to occur. The copolymers of this invention are also useful as adhesives; as binders for solid propellant compositions and as binders for gas producing substances. The binder is effective in desensitizing the composition from mechanical shock such as bullet or fragment impact. Thus, under enemy fire, bombs contacting it are less likely to detonate and destroy the aircraft or carrier and in large scale explosions in ammunition dumps, detonation of one item is less likely to set off the others.

DESCRIPTION OF THE PREFERRED EMBODIMENTS

When the copolymers of this invention are utilized as binders for cast explosive compositions, it is preferable to precoat sensitive filler ingredients with a water insoluble, low-volatility termonomer before preparing the cast composition. A cast explosive composition may be conveniently prepared according to Example 1.

EXAMPLE 1

First, an aqueous suspension of the non-soluble (in water) fillers (such as, for example, HMX or RDX) is prepared. Next, a solution of either di-2-ethylhexyl maleate or di-n-butyl maleate in a suitable organic solvent (such as, for example, dichloromethane) is added to the aqueous suspension. When this second step is carried out, the maleate derivative coats the fillers and coated filler particles settle to the bottom of the container. Next the water and all possible organic solvent are decanted. Next, residual organic solvent and water are removed by evaporation. This leaves dry, maleate coated filler particles. Next, the two monomers, 2-ethylhexyl acrylate and N-vinyl-2-pyrrolidone (40 to 90 weight percent acrylate and 60 to 10 weight percent pyrrolidone), a small amount (0.1 to 015 weight percent) of a crosslinker such as triethylene glycol dimethacrylate, tetramethylene diacrylate or their homologues and whatever special derivatives one wishes to add (such as p-tertiary butyl catechol to prolong shelf life, colloidal silica to control viscosity or an oxidizer powder such as sodium, potassium or ammonium perchlorate) or aluminum are combined and thoroughly mixed in a mixer. The coated explosive is then added to and mixed with the binder. After mixing until homogeneous, from 0.5 to 1 weight percent of a curative is added to the contents of the mixer. A suitable curative may be a peroxide such as t-butyl hydroperoxide with prior addition of cobalt acetylacetonate to serve as an accelerator. After the curative has been added, the contents of the mixer are stirred again for several minutes then the contents of the mixer are cast and allowed to cure. Explosive compositions containing from as little as 7.0 weight percent binder (with a balance of explosive fillers to make a total of 100 weight percent) to as much as 30 weight percent binder may be prepared this way. In the process the three monomers, 2-ehtylhexyl acrylate, N-vinyl-2-pyrrolidone and the maleate derivative react to form a terpolymer.

Explosive compositions prepared according to the foregoing procedure exhibit excellent qualities insofar as resistance to cracking under stress and resistance to cracking when undergoing temperature cycling are concerned. They may be readily detonated by means of ordinary detonating procedures commonly used with other plastic bonded explosives.

In addition to being useful as binders for explosive compositions, the copolymers of this invention are useful alone as adhesives and are useful as binders for propellant compositions. They may also be used as binders for pyrotechnic compositions and as binders for gas producing substances. A brief discussion of their preparation for such uses appears in Examples 2 and 3.

EXAMPLE 2

To prepare an adhesive one simply reacts 2-ethylhexyl acrylate and N-vinyl-2-pyrrolidone in the optimal presence of a crosslinker such as triethylene glycol dimethacrylate, tetramethylene diacrylate or a homologue. As in the case of the binder of Example 1, from 40 to 90 weight percent of the 2-ethylhexyl acrylate and from 60 to 10 weight percent of N-vinyl-2-pyrrolidone is used. Also, as in the case of the binder of Example 1, from 0.1 to 0.5 weight percent of the crosslinker is used. The resulting copolymer is very tacky and forms an excellent adhesive. The crosslinker is omitted if the cured adhesive is to be applied from solution in a solvent but it may be included if the adhesive is to be cured in situ from a monomeric mixture.

EXAMPLE 3

To prepare a binder for a propellant, pyrotechnic article or gas producing substance, the procedure of Example 1 may be used substituting, of course, propellant, pyrotechnic, or gas producing ingredients for the explosive fillers and the like of Example 1.

Example 4 below describes, in some detail, one explosive composition that was made and subjected to various impact and cookoff tests. The example also gives the results of the tests. While the Example specifies certain weight percentages for the ingredients, it is to be realized that the inventors do not wish to limit themselves to those percentages. Other tests with other compositions (in different weight percentage ranges) have been conducted with results similar to those described in the Example. That is, cast explosive compositions containing from 70 to 93 weight percent explosive fillers made up (1) entirely of explosive such as HMX; (2) partially of explosive such as HMX and partially of aluminum powder; and (3) partially of explosive, partially of aluminum and partially of perchlorates bound in from 30 to 7 weight percent of the copolymeric binder of this invention all will give results similar to those described in Example 4 if subjected to similar test conditions.

EXAMPLE 4

An explosive composition (made according to Example 1) containing about 86 weight percent RDX powder, as explosive filler and 14 weight percent of copolymeric binder made up by reacting 42 parts by weight 2-ethylhexyl acrylate 28 parts N-vinyl-2-pyrrolidone and 30 parts di-2-ethylhexyl maleate (precoated on the RDX) in the presence of triethylene glycol dimethacrylate crosslinker (0.1 weight percent) and cobalt acetylacetonate (0.1 weight percent) cured by adding 1.0 weight percent peroxide was prepared and then subjected to impact tests, slow cookoff tests and fast cookoff tests.

The impact tests consisted of firing 50 caliber projectiles at the composition. Seventy shots were fired with no detonations resulting.

The fast cookoff tests consisted of suspending bombs containing the cast explosive composition over a burning pool of jet fuel. In these tests, the bomb casings ruptured and the explosive composition burned but no detonations occurred. Bomblets and bombs containing from 2 pounds up to 100 pounds of the explosive were tested in fast cookoff studies.

The slow cookoff tests consisted of placing bombs containing 100 pounds of the explosive on combustable platforms and igniting the platforms so they would burn slowly. In a series of tests, some bomb casings ruptured and some did not. When a bomb casing ruptured, the explosive would ooze out and slowly burn. No detonations occurred in any case. No deterious effects on the explosive could be detected upon opening the unruptured bombs after tests. In these cases, the bombs were closed and reused in subsequent tests.

Example 1, Example 3, and Example 4 relate to cast explosive compositions. 2-Ethylhexyl acrylate and N-vinyl-2-pyrrolidone may also be polymerized and utilized to make pressed explosive compositions. In pressed compositions as little as 3 weight percent binder and as much as 30 weight percent binder may be used. A pressed composition may be prepared by following the procedure set forth in Example 5.

EXAMPLE 5

First, prepare and cure a copolymer from 2-ethylhexyl acrylate (40 to 90 weight percent) and N-vinyl-2-pyrrolidone (60 to 10 weight percent) by mixing the two liquids, adding cobalt acetylacetonate (0.1 weight percent) and then adding a peroxide (1 weight percent). (Any peroxide such as t-butyl hydroperoxide or the like may be used. Also, there are other acceptible methods for preparing the copolymer.) Next, the solid copolymer is dissolved in a suitable solvent such as a mixture of dichloromethane and acetone. The explosive filler is then slurried in water and the solution of copolymer is slowly added to the slurry. The copolymer is thus precipitated onto the explosive particles in the sulrry. The organic solvent is periodically removed by evacuation. It has been found that removing the organic solvent two or three times during the addition step is helpful. After the addition is complete, decant the liquid, filter, dry and press at 80° to 90° C. for up to 2 minutes under a pressure of 20,000 to 30,000 psi.

HMX, RDX, Al and other solid additives may be readily incorporated into pressed solid billets based on the binder described herein by following the method of this example.

What is claimed is:

1. A method for preparing an explosive composition comprising the steps of:

a. coating explosive filler particles selected from the group consisting of cyclotetramethylenetetranitramine and cyclotrimethylenetrinitramine with a monomer selected from the group consisting of di-2-ethylhexyl maleate and di-n-butyl maleate to form maleate coated explosive filler particles;

b. mixing about 40 to about 90 weight percent 2-ethylhexyl acrylate with about 60 to about 10 weight percent N-vinyl-2-pyrrolidone and about 0.1 to about 0.015 weight percent of a material selected from the group consisting of triethylene glycol dimethacrylate and tetramethylene diacrylate to form a mixture;

c. combining the maleate coated explosive filler particles with the mixture and mixing to form a homogeneous mixture;

d. combining from about 0.5 to 1 weight percent of a peroxide curative with the homogenious mixture, mixing in the curative, casting and curing whereby a terpolymer of the maleate, the acrylate and the pyrrolidone is formed as a binder.

2. A method according to claim 1 wherein the relative amounts of explosive filler particles, maleate, acrylate and pyrrolidone are chosen in a manner whereby the resulting explosive composition contains from about 7 to about 30 weight binder and a balance of explosive filler.

* * * * *